US008962543B2

(12) United States Patent
Lingler et al.

(10) Patent No.: US 8,962,543 B2
(45) Date of Patent: Feb. 24, 2015

(54) DISHWASHING COMPOSITION

(75) Inventors: Steffen Lingler, Ludwigshafen (DE); Judith Preuschen, Ludwigshafen (DE)

(73) Assignee: Reckitt Benckiser N.V., Hoofddorp (NL)

( * ) Notice: Subject to any disclaimer, the term of this patent is extended or adjusted under 35 U.S.C. 154(b) by 926 days.

(21) Appl. No.: 13/123,316

(22) PCT Filed: Oct. 13, 2009

(86) PCT No.: PCT/GB2009/002447

§ 371 (c)(1), (2), (4) Date: May 5, 2011

(87) PCT Pub. No.: WO2010/043854

PCT Pub. Date: Apr. 22, 2010

(65) Prior Publication Data

US 2012/0103370 A1 May 3, 2012

(30) Foreign Application Priority Data

Oct. 14, 2008 (GB) ..... 0818804.7

(51) Int. Cl.

| | |
|---|---|
| ***C11D 3/39*** | (2006.01) |
| ***C11D 3/20*** | (2006.01) |
| ***C11D 3/32*** | (2006.01) |
| ***C11D 3/33*** | (2006.01) |
| ***C11D 3/34*** | (2006.01) |
| ***C11D 3/36*** | (2006.01) |
| *C11D 3/395* | (2006.01) |

(52) U.S. Cl.

CPC ..... *C11D 3/2089* (2013.01); *C11D 3/3905* (2013.01); *C11D 3/3932* (2013.01); *C11D 3/395* (2013.01); *C11D 3/32* (2013.01); *C11D 3/33* (2013.01); *C11D 3/3472* (2013.01); *C11D 3/365* (2013.01)

USPC ..... 510/220; 510/375; 510/376

(58) Field of Classification Search

CPC ..... C11D 3/3905; C11D 3/3932; C11D 3/395

USPC ..... 510/220, 275, 276

See application file for complete search history.

(56) References Cited

U.S. PATENT DOCUMENTS

| | | | | | |
|---|---|---|---|---|---|
| 3,308,067 | A | * | 3/1967 | Diehl | 510/346 |
| 4,228,300 | A | * | 10/1980 | Lannert | 560/180 |
| 4,687,592 | A | * | 8/1987 | Collins et al. | 510/376 |
| 2006/0049077 | A1 | | 3/2006 | Fregonese et al. | |

FOREIGN PATENT DOCUMENTS

| | | | |
|---|---|---|---|
| DE | 23 04 404 | A1 | 6/1974 |
| DE | 10 2007 006628 | A1 | 8/2008 |

OTHER PUBLICATIONS

Yoshiro et al; "Organic builders. XI. Buildign performances of malonate-type ether polycarboxylic acids"; XP002969775, Jan. 1, 1981, retrieved from Chemical Abstracts, abstract.

* cited by examiner

*Primary Examiner* — Gregory Webb

(74) *Attorney, Agent, or Firm* — Troutman Sanders, LLP; Ryan A. Schneider; Chris Davis

(57) ABSTRACT

A dishwasher detergent composition comprising from 0.05 to 7.5 wt % of a surfactant and from 0.1 to 90 wt % of a compound of Formula 1;

Formula 1

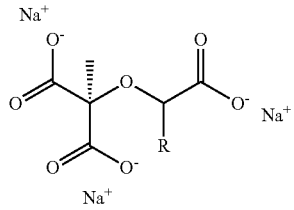

wherein R is selected from the group consisting of —H, —$CH_3$, —$C_nH_{2n}CH_3$, —$C_nH_{2n}OH$, —$C_nH_{2n}COOH$, —$C_nH_{2n}SO_3H$, —$C_nH_{2n}NH_2$, —$C_nH_{2n}NHR'$, —$C_nH_{2n}NR'_2$, —NHC(=O)—R' and —$C_nH_{2n}PO(OR')_2$; wherein n≥1; and R' is H, alkyl or aryl, and further wherein the composition comprises a bleach selected from inorganic peroxy compounds, organic peracids and salts derived therefrom. The compound of Formula 1 is biodegradable, stable to bleach and yet is an effective builder. The compositions of the invention can be readily formulated as tablet compositions if desired as the compound of Formula 1 is not overly hygroscopic.

26 Claims, No Drawings

DISHWASHING COMPOSITION

This is an application filed under 35 USC 371 of PCT/GB2009/002447.

The invention relates to a detergent composition for machine dishwashing.

In recent years there has been an ever increasing trend towards safer and environmentally friendly detergent compositions. This has led to the development of alternative complexing agents (builders), which are used instead of predominantly phosphorous based builders. Phosphate builders have been connected with eutrophication issues.

On the other hand phosphates can bind calcium and magnesium ions, can act as alkalinity source for the detergent, and are used to buffer the wash liquor in a dishwasher above pH 9 together with other chemicals such as disilicate, metasilicates and soda. Phosphates are also able to disperse existing calcium carbonate in the wash liquor to prevent 'spotting' on glassware.

Thus, replacing phosphates in a detergent requires compensating at least four different functions in an alkaline detergent, namely (1) Providing alkalinity; (2) buffering capacity, (3) complexing of magnesium and calcium ions; and (4) dispersing capacity of calcium carbonate.

To overcome this problem of finding an alternative to sodium tripolyphosphate (STPP) organic molecules such as citrate have been identified. Citrate has the advantage that it is biodegradable and is widely available. It is a crystalline material that can be easily purified. The disadvantage is that the washing performance is poorer compared to phosphates.

In the patent literature other molecules have been cited as possible replacements for sodium tripolyphosphate.

U.S. Pat. No. 3,293,176 describes molecules that have multiple numbers of carboxylic, phosphoric or sulfonic groups. The described molecules are asymmetric ethers that are based on lactate and malonate.

U.S. Pat. No. 4,025,450 and U.S. Pat. No. 4,228,300 describe the preparation of certain polycarboxylate ether compounds and their application as builders in phosphate free detergent compositions further containing a surfactant. In particular U.S. Pat. No. 4,228,300 requires that the compounds disclosed contain hydrogen groups or methyl or ethyl groups and the presence of at least 8% wt surfactant in the compositions.

DE 2 304 404 discloses compositions for use in machine dishwashers, the compositions comprising certain polycarboxylate ether compounds, non-ionic surfactants and active chlorine containing compounds Unexpectedly it has been found that certain organic polycarboxylate phosphorous free builders give an excellent performance as builders in dishwashing compositions, are stable to interaction with bleach components and are also biodegradable. Furthermore it has been found that these builders are not overly hygroscopic in nature and thus can be readily incorporated into compositions which are in the form of a shaped body such as detergent tablets.

According to a first aspect of the present invention there is provided a dishwasher detergent composition comprising:

from 0.05 to 7.5 wt % of a surfactant; and, from 0.1 to 90 wt % of a compound of Formula 1

Formula 1

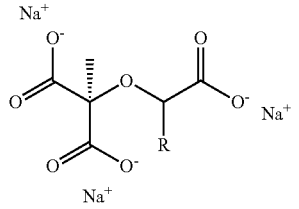

wherein R is selected from the group consisting of —H, —$CH_3$, —$C_nH_{2n}CH_3$, —$C_nH_{2n}OH$, —$C_nH_{2n}COOH$, —$C_nH_{2n}SO_3H$, —$C_nH_{2n}NH_2$, —$C_nH_{2n}NHR'$, —$C_nH_{2n}NR'_2$, —NHC(=O)—R' and —$C_nH_{2n}PO(OR')_2$; wherein n≥1; and R' is H, alkyl or aryl, and further wherein the composition comprises a bleach selected from inorganic peroxy compounds, organic peracids and salts derived therefrom.

Preferably n is from 1 to 10, more preferably from 1 to 7, most preferably from 1 to 4, particularly 1 or 2. Especially preferred is —$CH_3$.

In a second embodiment of the invention, there is provided a dishwasher detergent composition comprising a compound of Formula 1 wherein R is selected from the group consisting of —$C_nH_{2n}CH_3$, —$C_nH_{2n}OH$, —$C_nH_{2n}COOH$, —$C_nH_{2n}SO_3H$, —$C_nH_{2n}NHR'$, —$C_nH_{2n}NR'_2$, —NHC(=O)—R' and —$C_nH_{2n}PO(OR')_2$; wherein n and R' are as defined above for the first embodiment of the invention with the proviso that in $C_nH_{2n}CH_3$ n is an integer of 2 or more.

In a third embodiment of the invention, there is provided a dishwasher detergent composition comprising a compound of Formula 1 as defined for the first embodiment of the invention and a cobuilder.

The dishwasher detergent composition according to any of the embodiments of the invention as hereinbefore described preferably comprises from 5 to 90% wt, preferably 10 to 80% wt, more preferably 20 to 75% wt, especially from 30 to 70% wt of a compound according to Formula 1 as hereinbefore defined.

Surfactant

Preferably the dishwasher detergent composition according to the second or third aspect of the invention further comprises a surfactant, more preferably from 0.05 to 7.5 wt % of a surfactant.

The surfactant comprised by the dishwasher detergent composition according to either of the first or second embodiments of the invention as hereinbefore described is preferably selected from anionic, non-ionic, cationic, amphoteric or zwitterionic surface active agents or mixtures thereof, most preferably non-ionic, cationic and amphoteric surfactants. Many such surfactants are described in Kirk Othmer's Encyclopedia of Chemical Technology, 3rd Ed., Vol. 22, pp. 360-379, "Surfactants and Detersive Systems", incorporated by reference herein. In general, non-ionic surfactants are preferred.

One possible class of nonionic surfactants are ethoxylated non-ionic surfactants prepared by the reaction of a monohydroxy alkanol or alkylphenol with 6 to 20 carbon atoms with at least 3 moles, preferably at least 6 moles, more preferably at least 9 moles, further preferably at least 12 moles, particularly preferably at least 16 moles, and still more preferably at least 20 moles of ethylene oxide per mole of alcohol or alkylphenol.

Particularly preferred non-ionic surfactants are the non-ionics from a linear chain fatty alcohol with 16-20 carbon atoms and at least 12 moles particularly preferred at least 16 and still more preferred at least 20 moles of ethylene oxide per mole of alcohol.

According to one preferred embodiment of the invention, the non-ionic surfactants additionally comprise propylene oxide (PO) units in the molecule. Preferably these PO units constitute up to 25% by weight, preferably up to 20% by weight and still more preferably up to 15% by weight of the overall molecular weight of the non-ionic surfactant. Particularly preferred surfactants are ethoxylated mono-hydroxy alkanols or alkylphenols, which additionally comprises polyoxyethylene-polyoxypropylene block copolymer units. The alcohol or alkylphenol portion of such surfactants constitutes more than 30%, preferably more than 50%, more preferably more than 70% by weight of the overall molecular weight of the non-ionic surfactant.

Another class of suitable non-ionic surfactants includes reverse block copolymers of polyoxyethylene and polyoxypropylene and block copolymers of polyoxyethylene and polyoxypropylene initiated with trimethylolpropane.

Another preferred class of nonionic surfactant can be described by the formula:

$$R^1O[CH_2CH(CH_3)O]_x[CH_2CH_2O]_y[CH_2CH(OH)R^2]$$

where $R^1$ represents a linear or branched chain aliphatic hydrocarbon group with 4-18 carbon atoms or mixtures thereof, $R^2$ represents a linear or branched chain aliphatic hydrocarbon rest with 2-26 carbon atoms or mixtures thereof, x is a value between 0.5 and 1.5 and y is a value of at least 15.

Another group of preferred nonionic surfactants are the end-capped polyoxyalkylated non-ionics of formula:

$$R^1O[CH_2CH(R^3)O]_x[CH_2]_kCH(OH)[CH_2]_jOR^2$$

where $R^1$ and $R^2$ represent linear or branched chain, saturated or unsaturated, aliphatic or aromatic hydrocarbon groups with 1-30 carbon atoms, $R^3$ represents a hydrogen atom or a methyl, ethyl, n-propyl, iso-propyl, n-butyl, 2-butyl or 2-methyl-2-butyl group, x is a value between 1 and 30 and, k and j are values between 1 and 12, preferably between 1 and 5. When the value of x is >2 each $R^3$ in the formula above can be different. $R^1$ and $R^2$ are preferably linear or branched chain, saturated or unsaturated, aliphatic or aromatic hydrocarbon groups with 6-22 carbon atoms, where group with 8 to 18 carbon atoms are particularly preferred. For the group $R^3H$, methyl or ethyl are particularly preferred. Particularly preferred values for x are comprised between 1 and 20, preferably between 6 and 15.

As described above, in case x>2, each $R^3$ in the formula can be different. For instance, when x=3, the group $R^3$ could be chosen to build ethylene oxide ($R^3$=H) or propylene oxide ($R^3$=methyl) units which can be used in every single order for instance (PO)(EO)(EO), (EO)(PO)(EO), (EO)(EO)(PO), (EO)(EO)(EO), (PO)(EO)(PO), (PO)(PO)(EO) and (PO)(PO)(PO). The value 3 for x is only an example and bigger values can be chosen whereby a higher number of variations of (ED) or (PO) units would arise.

Particularly preferred end-capped polyoxyalkylated alcohols of the above formula are those where k=1 and j=1 originating molecules of simplified formula:

$$R^1O[CH_2CH(R^3)O]_xCH_2CH(OH)CH_2OR^2$$

The use of mixtures of different nonionic surfactants is suitable in the context of the present invention for instances mixtures of alkoxylated alcohols and hydroxy group containing alkoxylated alcohols.

Other suitable surfactants are disclosed in WO 95/01416, to the contents of which express reference is hereby made.

In a particularly preferred embodiment of either the first or the second aspect of the present invention, the surfactant comprised by the composition is nonionic wherein at least 50 wt % of the nonionic surfactant has a melting point of 35° C., preferably >40° C. Preferably this nonionic surfactant is selected from one or more hydroxyalkyl polyglycolethers and optionally endcapped polyalkylated alcohols having at least 30 alkyleneoxy groups and mixtures thereof.

Cobuilder

The composition according to either of the first or second embodiment of the present invention may comprise a further builder, hereinafter cobuilder.

Where a cobuilder(s) is present, it is preferably present in the composition in an amount of at least 2 wt %, preferably at least 3 wt %, more preferably at least 4 wt %, and most preferably at least 5 wt %.

Where a cobuilder(s) is present, it is preferably present in the composition in an amount of up to 40 wt %, preferably up to 25 wt %, more preferably up to 20 wt %, and most preferably up to 15 wt %.

According to one embodiment the cobuilder is present in an amount of from 2 wt % to 40 wt %.

Cobuilders which are organic are preferred, and include homopolymers and copolymers of polycarboxylic acids and their partially or completely neutralized salts, additional monomeric polycarboxylic acids and hydroxycarboxylic acids and their salts, phosphates and phosphonates, and mixtures of such substances. Preferred salts of the abovementioned compounds are the ammonium and/or alkali metal salts, i.e. the lithium, sodium, and potassium salts, and particularly preferred salts are the sodium salts.

An exemplary suitable polycarboxylic acid is the homopolymer of acrylic acid. A further suitable polycarboxylic acid is poly-aspartic acid, namely polymers containing monomer units derived from aspartic acid of the formula

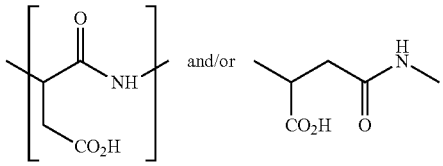

A yet further suitable organic cobuilder is a sulfonated polymer(s). Preferred examples of suitable sulphonated polymers include copolymers of $CH_2{=}CR^1{-}CR^2R^3{-}O{-}C_4H_3R^4{-}SO_3X$ wherein $R^1$, $R^2$, $R^3$, $R^4$ are independently 1 to 6 carbon alkyl or hydrogen, and X is hydrogen or alkaline metal with any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Other suitable sulfonated monomers for incorporation in the composition include sulphonated (co)polymers such as 2-acrylamido-2-methyl-1-propanesulfonic acid, 2-methacrylamido-2-methyl-1-propanesulfonic acid, 3-methacrylamido-2-hydroxypropanesulfonic acid, allysulfonic acid, methallysulfonic acid, 2-hydroxy-3-(2-propenyloxy)propanesulfonic acid, 2-methyl-2-propenen-1-sulfonic acid, styrenesulfonic acid, vinylsulfonic acid, 3-sulfopropyl acrylate, 3-sulfopropylmethacrylate, sulfomethylacrylamide, sulfomethylmethacrylamide and water soluble salts thereof. It is especially preferred that the sulphonated polymer comprises 2-acrylamido-2-methyl-1-propanesulfonic acid.

Suitable sulfonated polymers are also described in U.S. Pat. No. 5,308,532 and in WO 2005/090541.

Sulfonated polymers are used in detergency applications as polymers to disperse Ca-phosphate compounds and prevent their deposition. Surprisingly, we have found such polymers to give cleaning benefits in combination even with preferred phosphorus-free compositions of the present invention.

Other suitable cobuilders are disclosed in WO 95/01416, to the contents of which express reference is hereby made.

Although phosphorus-containing cobuilders may be present in this invention, preferred compositions are substantially free of phosphorous-containing compounds. By this is meant that the compositions do not comprise more than 5% wt phosphorous containing compounds, preferably not more than 1% wt phosphorus-containing compound(s).

Enzyme

The dishwasher detergent composition according to either of the first or second embodiments of the invention as hereinbefore described may further comprise from 0.01 to 5 wt % of one or more enzyme granules, preferably selected from the group consisting of protease, amylase, cellulase, lipase, laccase, oxidases, tyrosinases, mannanases and peroxidase enzymes.

Such enzymes are commercially available and sold, for example, under the registered trade marks Esperase, Alcalase and Savinase by Novo Industries A/S. Desirably the enzyme(s) is/are present in the composition in an amount of from 0.01 to 3 wt %, especially 0.01 to 2 wt % enzyme granule.

Bleach

A bleach component may be present in a composition of the invention. When a bleach is present, it is preferably present in the composition in an amount of at least 1 wt %, more preferably at least 2 wt %, more preferably at least 4 wt %.

When a bleach is present, it is preferably present in the composition in an amount of up to 30 wt %, more preferably up to 20 wt %, and most preferably up to 15 wt %. Amounts of 1% to 30% wt of bleach component are especially preferred.

Most preferably a bleach is selected from inorganic peroxy-compounds and organic peracids and the salts derived therefrom.

It is especially preferred according to the present invention that the detergent composition further comprises from 1 wt % to 30 wt % of a bleach component selected from inorganic peroxy-compounds and organic peracids and salts derived therefrom.

Examples of inorganic perhydrates are persulfates such as peroxymonopersulfate (KMPS), Perborates or percarbonates. The inorganic perhydrates are normally alkali metal salts, such as lithium, sodium or potassium salts, in particular sodium salts. The inorganic perhydrates may be present in the detergent as crystalline solids without further protection. For certain perhydrates, it is however advantageous to use them as granular compositions provided with a coating which gives the granular products a longer shelf life.

The preferred percarbonate is sodium percarbonate of the formula $2Na_2CO_3.3H_2O_2$. A percarbonate, when present, is preferably used in a coated form to increase its stability.

Organic peracids include all organic peracids traditionally used as bleaches, including, for example, perbenzoic acid and peroxycarboxylic acids such as mono- or diperoxyphthalic acid, 2-octyldiperoxysuccinic acid, diperoxydodecanedicarboxylic acid, diperoxy-azelaic acid and imidoperoxycarboxylic acid and, optionally, the salts thereof. Especially preferred is phthalimidoperhexanoic acid (PAP).

Where bleach is present in a composition of the present invention, the composition may also comprise one or more bleach activators. These activators are preferably used in detergents for dishwashing cycles at temperatures in the range below 60° C. in order to achieve an adequate bleaching action. Particularly suitable examples are N- and O-acyl compounds, such as acylated amines, acylated glycolurils or acylated sugar compounds. Preference is given to pentaacetylglucose (PAG) and tetraacetylglycoluril (TAGU).

The dishwasher detergent composition according to either of the first or second embodiments of the invention as hereinbefore described may further comprise from 0.005 to 0.1 wt % of a bleach catalyst selected from the salts of manganese, iron, cobalt, zinc, nickel, titanium or vanadium or mixtures thereof, preferably selected from organic manganese salts, inorganic manganese salts or organometallic manganese compounds, or mixtures thereof.

Bleach activators may also be present as co-granulates, which give a better dosage and a better dissolution profile.

An especially preferred bleach catalyst has the following formula

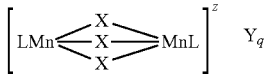

wherein each Mn is individually in the III or IV oxidation state and each x represents a coordinating or bridging species selected from the group consisting of $H_2O$, $O_2^{2-}$, $O^{2-}$, $OH^-$, $HO_2^-$, $SH^-$, $S^{2-}$, >SO, $Cl^-$, $N^{3-}$, $SCN^-$, $RCOO^-$, $NH_2^-$ and $NR_3$, with R being H, alkyl or aryl, (optionally substituted); L is a ligand which is an organic molecule containing a number of nitrogen atoms which coordinates via all or some of its nitrogen atoms to the manganese centres; z denotes the charge of the complex and is an integer which can be positive or negative; Y is a monovalent or multivalent counter-ion, leading to charge neutrality, which is dependent upon the charge z of the complex; and $q=^{z/}$[charge Y].

The composition according to either of the first or second embodiment of the present invention preferably comprises from 0.01 wt % to 1 wt %, more preferably from 0.05 wt % to 0.5 wt %, most preferably from 0.05 wt % to 0.1 wt % of a bleach activator.

Alkalinity Source

The dishwasher detergent according to the invention may also comprise a source of alkalinity to obtain the desired alkaline pH on dissolution. Typically the alkalinity may be any of the components which are basic; for example, any salt of a strong base and a weak acid. It is especially preferred according to the present invention that the compositions comprise a suitable amount of carbonate or a source of carbonate. Typically the source of alkalinity will be present in an amount of from 1 to 30% wt, more preferably 5 to 15% wt.

In the case of alkaline compositions silicates may be suitable additives. Preferred silicates are sodium silicates such as sodium disilicate, sodium metasilicate and crystalline phyllosilicates.

Preferably the composition of the present invention yields an alkaline washing medium when contacted with water and preferably it is an alkaline dishwasher detergent composition. Thus, preferred embodiments of the invention are adapted to produce alkaline washing liquors. For the purposes of this specification alkaline is defined as pH 8 to pH 12, and more preferably from pH 8.5 to pH 11; when dissolved 1:100 (wt:wt, composition:water) in de-ionised water at 20° C., measured using a conventional pH meter.

Foam Control Agent

The detergent composition according to the present invention may further comprise one or more foam control agents. Suitable foam control agents for this purpose are all those used in this field, such as, for example, silicones and paraffin oil. Foam control agents are preferably present in amounts of less than 5% by weight of the total weight of the detergent.

Suitable paraffin oils are predominantly branched aliphatic hydrocarbons having a number of carbon atoms in the range from 20 to 50. Preference is given to the paraffin oil chosen from predominantly branched-chain $C_{25-45}$ species having a ratio of cyclic to noncyclic hydrocarbons of from 1:10 to 2:1, preferably from 1:5 to 1:1.

Corrosion Inhibitor

The detergent composition according to the invention may also comprise a silver/copper corrosion inhibitor. This term encompasses agents which are, intended to prevent or reduce the tarnishing of non-ferrous metals, in particular of silver and copper.

Suitable silver/copper corrosion inhibitors include organic and/or inorganic redox-active substances, for example benzotriazole derivatives. Such benzotriazole derivatives are compounds in which the available substitution sites on the aromatic ring are partially or completely substituted. Suitable substituents are linear or branch-chain $C_{1-20}$-alkyl groups and hydroxyl, thio, phenyl or halogen such as fluorine, chlorine, bromine and iodine. A preferred substituted benzotriazole is tolyltriazole.

Suitable bis-benzotriazoles derivatives are those in which the benzotriazole groups are each linked in the 6-position by a group X, where X may be a bond, a straight-chain alkylene group which is optionally substituted by one or more $C_{1-4}$-alkyl groups and preferably has 1-6 carbon atoms, a cycloalkyl radical having at least 5 carbon atoms, a carbonyl group, a sulfuryl group, an oxygen atom or a sulfur atom. The aromatic rings of the bis-benzotriazoles may be substituted as defined above for benzotriazole.

Suitable organic redox-active substances are, for example, ascorbic acid, indole, methionine, an N-mono-($C_1$-$C_4$-alkyl) glycine, an N,N-di-($C_1$-$C_4$-alkyl)glycine, 2-phenylglycine or a coupler and/or developer compound chosen from the group consisting of diaminopyridines, aminohydroxypyridines, dihydroxypyridines, heterocyclic hydrazones, aminohydroxypyrimidines, dihydroxypyrimidines, tetraaminopyrimidines, triaminohydroxypyrimidines, diaminodihydroxypyrimidines, dihydroxynaphthalenes, naphthols, pyrazolones, hydroxyquinolines, aminoquinolines, of primary aromatic amines which, in the ortho-, meta- or paraposition, have another hydroxyl or amino group which is free or substituted by $C_1$-$C_4$-alkyl or $C_2$-$C_4$-hydroxyalkyl groups, and of di- or trihydroxybenzenes.

Suitable inorganic redox-active substances are, for example, metal salts and/or metal complexes chosen from the group consisting of manganese, titanium, zirconium, hafnium, vanadium, cobalt and cerium salts and/or complexes, the metals being in One of the oxidation states II, III, IV, V or VI.

Particularly suitable metal salts and/or metal complexes are chosen from the group consisting of Mn(II) acetate, Mn(II)-$SO_4$, Mn(II) citrate, Mn(II) stearate, Mn(II) acetylacetonate, Mn(II) [1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$.

Organic and inorganic redox-active substances which are suitable as silver/copper corrosion inhibitors are also mentioned in WO 94/26860 and WO 94/26859, to the contents of which reference is hereby made.

If a silver/copper corrosion inhibitor is present in the detergent composition according to the invention, it is preferably present in an amount of from 0.01 to 5% by weight, particularly preferably in an amount of from 0.1 to 2% by weight, of the total weight.

Other customary additives are, for example, dyes and perfumes and optionally in the case of liquid products, preservatives, suitable examples of which are compounds based on isothiazolinone.

The detergent compositions of the invention may be in any suitable form such as a liquid, gel, powder, tablet or a rigid capsule made out of polyvinylalcohol (PVOH) with more than 1 compartment. Where the composition is a liquid/gel generally the builder compound according to Formula 1 will be present in solution within the liquid/gel. According to one embodiment it is especially preferred that the composition is in the form of a tablet as it has been found that the compositions of the present invention are very suitable for forming a tablet.

Preferably the composition has a solids content of more than 25% wt, and preferably more than 50% wt.

The composition of the present invention may, for example, be in the form of a tablet, rod, ball or lozenge. The composition may be provided in a particulate form, loose or pressed to shape or may be formed by injection moulding or by casting or by extrusion. The composition may be encased in a water soluble wrapping, for, example of PVOH or a cellulosic material. The composition may be a gel or a powder. It may also include a pressed pill or gelatine ball, injection moulded ball.

Preferably the compositions according to the invention are for washing dishes in the presence of hard water, for example hard water with a hardness >10° German hardness.

According to the third aspect of the present invention it is preferred that the water provided to the automatic dishwashing machine has a hardness of at least 10° German hardness.

Preferred is a dishwasher detergent composition, according to either of the first or second embodiments of the invention as hereinbefore described, comprising:

from 0.1 to 90 wt % of a compound of Formula 1;
from 0.05 to 7.5 wt % of a surfactant;
from 0.01 to 5 wt % of one or more enzyme granules;
from 1 to 30 wt % of bleach; and,
from 0.005 to 0.1 wt % of a bleach catalyst.

Especially preferred is a dishwasher detergent composition according either of the first or second embodiments of the invention as hereinbefore described, comprising:

from 10.0 to 70 wt % of a compound of Formula 1;
from 0.5 to 5.0 wt % of a surfactant;
from 0.5 to 2 wt % of one or more enzyme granules;
from 5 to 20 wt % of bleach; and,
from 0.005 to 0.1 wt % of a bleach catalyst.

In a third aspect of the present invention, there is also provided a method of washing kitchenware in an automatic dishwashing machine wherein a detergent composition according to either of the first or second aspects of the present invention is added to the automatic dishwashing machine.

In a fourth aspect of the present invention, there is provided the use of a composition according to either of the first or second aspects of the present invention as hereinbefore described in a method of washing kitchenware according to the third aspect of the present invention.

EXAMPLES

The composition is described with reference to the following non-limiting Examples.

Formulation 1: Automatic Dishwashing Tablet

| Component | Wt % |
|---|---|
| Sodium carbonate | 6.5 |
| Sodium percarbonate | 12.0 |
| Trisodium citrate | 61.1 |
| TAED | 4.0 |
| Protease | 0.8 |
| Amylase | 0.4 |
| Benzotriazole | 0.1 |
| Sulphonated polyacrylate | 5.0 |
| Surfactant (fatty alcohol polyglycolether) | 1.0 |
| PEG 1500 | 7.0 |
| PEG 6000 | 2.0 |
| Perfume | 0.1 |
| Total | 100.0 |

The formulation has a pH of 10.2

Formulation 2: Automatic Dishwashing Tablet

| Component | Wt % |
|---|---|
| Sodium carbonate | 6.5 |
| Sodium percarbonate | 12.0 |
| Trisodium citrate | 11.1 |
| Trisodium-2-methyl-2-(1-oxido-1-oxopropan-2-yl)oxypropanoate (O-2-methylmalonyllactate) | 50.0 |
| TAED | 4.0 |
| Protease (Puramax 2250D) | 0.8 |
| Amylase (Stainzyme 12GT) | 0.4 |
| Benzotriazole | 0.1 |
| Sulphonated polyacrylate | 5.0 |
| Surfactant (fatty alcohol polyglycolether) | 1.0 |
| PEG 1500 | 7.0 |
| PEG 6000 | 2.0 |
| Perfume | 0.1 |
| Total | 100.0 |

The formulation has a pH of 10.2

APPLICATION EXAMPLES

The cleaning ability of the formulations was tested in a Miele 651 dishwashing machine using a 50° C. cycle Normal program following the IKW method. In each case 20 g of the powder was added into the dosing chamber of the dishwasher. The water hardness was 21° gH. The results (given in Table 1) are expressed on a scale of 1-10 (1 being worst and 10 being best).

These results show that the formulation based on O-2-methylmalonyllactate provides excellent cleaning results on tea stains at alkaline pH versus a citrate based formulation.

To increase the performance of the bleach and the enzymes, the concentration of those components can be increased.

TABLE 1

| Cleaning Performance | Formulation 1 | Formulation 2 |
|---|---|---|
| Bleachable Stain—Tea | 3.2 | 4.9 |
| Starch—dried on oat flakes | 9.0 | 8.3 |
| Starch—dried on starch mix | 7.2 | 6.1 |
| Protein—dried on minced meat | 7.3 | 8.0 |
| Protein—dried on egg yolk | 3.4 | 5.2 |
| Protein—dried on egg yolk/milk | 7.2 | 8.9 |
| Burnt-on—milk | 6.4 | 6.6 |

The invention claimed is:

1. A dishwasher detergent composition comprising:

(i) from 0.05 to 7.5 wt % of a surfactant; and, (ii) from 0.1 to 90 wt % of a compound of Formula 1;

Formula 1

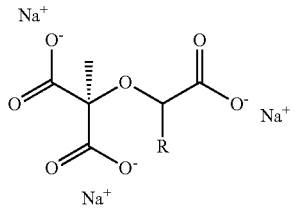

wherein R is selected from the group consisting of —H, —$CH_3$, —$C_nH_{2n}CH_3$, —$C_nH_{2n}OH$, —$C_nH_{2n}COOH$, —$C_nH_{2n}SO_3H$, —$C_nH_{2n}NH_2$, —$C_nH_{2n}NHR'$, —$C_nH_{2n}NR'_2$, —NHC(═O)—R' and —$C_nH_{2n}PO(OR')_2$;

wherein n≥1; and R' is H, alkyl or aryl, (iii) a bleach selected from inorganic peroxy compounds, organic peracids and salts derived therefrom and (iv) a bleach activator.

2. A dishwasher detergent composition according to claim 1, wherein R is —$CH_3$.

3. A dishwasher detergent composition comprising from 0.1 to 90 wt % of a compound of Formula 1;

Formula 1

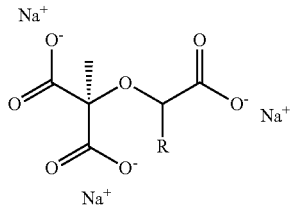

wherein

R is selected from the group consisting of —$C_nH_{2n}CH_3$, —$C_nH_{2n}OH$, —$C_nH_{2n}COOH$, —$C_nH_{2n}SO_3H$, —$C_nH_{2n}NH_2$, —$C_nH_{2n}NHR'$, —$C_nH_{2n}NR'_2$, —NHC(═O)—R' and —$C_nH_{2n}PO(OR')_2$;

wherein n≥1; and R' is H, alkyl or aryl with the proviso that in $C_nH_{2n}CH_3$ n is an integer of 2 or more.

4. A dishwasher detergent composition according to claim 3, wherein the composition further comprises a surfactant.

5. A dishwasher detergent composition according to claim 4, wherein the composition comprises from 0.05 to 7.5 wt % of a surfactant.

6. A dishwasher detergent composition comprising a compound of Formula 1;

Formula 1

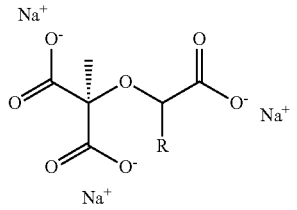

wherein R is selected from the group consisting of —H, —$CH_3$, —$C_nH_{2n}CH_3$, —$C_nH_{2n}OH$, —$C_nH_{2n}COOH$, —$C_nH_{2n}SO_3H$, —$C_nH_{2n}NH_2$, —$C_nH_{2n}NHR'$, —$C_nH_{2n}NR'_2$, —NHC(=O)—R' and —$C_nH_{2n}PO(OR')_2$;

wherein n≥1; and R' is H, alkyl or aryl;

and further wherein the composition comprises a cobuilder.

7. A dishwasher detergent composition according to claim 6, wherein the composition further comprises a surfactant.

8. A dishwasher detergent composition according to claim 7, wherein the composition comprises from 0.05 to 7.5 wt % of a surfactant.

9. A dishwasher detergent composition according to claim 1 wherein the surfactant is non-ionic.

10. A dishwasher detergent composition according to claim 9, wherein at least 50 wt % of the non-ionic surfactant has a melting point >35° C.

11. A dishwasher detergent composition according to claim 1 wherein the composition further comprises a cobuilder.

12. A dishwasher detergent composition according to claim 11 wherein the cobuilder is an organic cobuilder.

13. A dishwasher detergent composition according to claim 12, wherein the organic cobuilder is a biodegradable polymer.

14. A dishwasher detergent composition according to claim 12, wherein the organic cobuilder comprises polyaspartic acid.

15. A dishwasher detergent composition according to claim 12, wherein the organic cobuilder comprises a sulfonated polymer.

16. A dishwasher detergent composition according to claim 1, wherein the composition comprises from 5 to 90% wt of a compound according to Formula 1.

17. A dishwasher detergent composition according to claim 1, wherein the composition further comprises an enzyme selected from the group consisting of protease, amylase, cellulase, lipase, laccase, oxidases, tyrosinases, mannanases and peroxidase enzymes.

18. A dishwasher detergent composition according to claim 1, wherein the composition further comprises a bleach component selected from the group consisting of inorganic peroxy-compounds and organic peracids and salts derived therefrom.

19. A dishwasher detergent composition according to claim 1, wherein the bleach catalyst is selected from the group consisting of the salts of manganese, iron, cobalt, zinc, titanium, nickel or vanadium or mixtures thereof.

20. A dishwasher detergent composition according to claim 1, wherein the composition further comprises a silver/copper corrosion inhibitor selected from the group consisting of organic and inorganic redox-active substances.

21. A dishwasher detergent composition, according to claim 1, wherein the composition comprises:

(i) from 0.1 to 90 wt % of a compound of Formula 1;
(ii) from 0.05 to 7.5 wt % of a surfactant;
(iii) from 0.01 to 5 wt % of one or more enzyme granules;
(iv) from 1 to 30 wt % of bleach; and,
(v) from 0.005 to 0.1 wt % of a bleach catalyst.

22. A dishwasher detergent composition according to claim 21, wherein the composition comprises:

(i) from 10.0 to 70 wt % of a compound of Formula 1;
(ii) from 0.5 to 5.0 wt % of a surfactant;
(iii) from 0.5 to 2 wt % of one or more enzyme granules;
(iv) from 5 to 20 wt % of bleach; and,
(v) from 0.005 to 0.1 wt % of a bleach catalyst.

23. A dishwasher detergent composition according to claim 1, wherein the composition is in the form of a liquid, gel, powder, tablet, rod, ball, lozenge or rigid capsule with more than 1 compartment.

24. A method of washing kitchenware in an automatic dishwashing machine which method comprises the step of: adding a detergent composition according to claim 1 to the automatic dishwashing machine 25. A method according to claim 24, wherein the water provided to the automatic dishwashing machine has a hardness of at least 10° German hardness.

26. A dishwasher detergent composition according to claim 19, wherein the bleach catalyst is represented by the following formula:

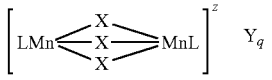

wherein:

each Mn is in the III or IV oxidation state, each x represents a coordinating or bridging species selected from the group consisting of: $H_2O$, $O_2^{2-}$, $O^{2-}$, $OH^-$, $HO_2^-$, $SH^-$, $S^{2-}$, SO, $Cl^-$, $N^{3-}$, $SCN^-$, $RCOO^-$, $NH_2^-$ and $NR_3$, in which R is H, alkyl or aryl and which alkyl or aryl may optionally be substituted, L is a ligand which is an organic molecule containing a number of nitrogen atoms which coordinates via all or some of its nitrogen atoms to the manganese centers;

Z denotes the charge of the complex and is an integer which can be positive or negative;

Y is a monovalent or is a multivalent counter-ion, leading to charge neutrality, which is dependent upon the charge z of the complex; and, q=z/[charge Y].

* * * * *